United States Patent [19]

Iizumi

[11] 4,192,346

[45] Mar. 11, 1980

[54] CONTROL VALVE

[75] Inventor: Tomomitsu Iizumi, Tokyo, Japan

[73] Assignee: Shoketsu Kinzoku Kogyo Kabushiki Kaisha, Tokyo, Japan

[21] Appl. No.: 826,251

[22] Filed: Aug. 19, 1977

[30] Foreign Application Priority Data

| | | | |
|---|---|---|---|
| Aug. 25, 1976 | [JP] | Japan | 113601[U] |
| Sep. 10, 1976 | [JP] | Japan | 121042[U] |
| Oct. 8, 1976 | [JP] | Japan | 134892[U] |
| Oct. 27, 1976 | [JP] | Japan | 144311[U] |
| Oct. 27, 1976 | [JP] | Japan | 144312[U] |
| Jul. 5, 1977 | [JP] | Japan | 881687[U] |

[51] Int. Cl.[2] ..... F15B 11/02

[52] U.S. Cl. ..... 137/599; 91/443; 91/447; 137/509

[58] Field of Search ..... 91/443, 447; 137/493.8, 137/599, 509

[56] References Cited

U.S. PATENT DOCUMENTS

| | | | |
|---|---|---|---|
| 840,876 | 1/1907 | Steedman | 91/443 |
| 2,499,262 | 2/1950 | Stoudt | 91/443 X |
| 2,570,937 | 10/1951 | Gash | 137/493.8 |
| 4,000,684 | 1/1977 | Ruffley | 137/509 |

*Primary Examiner*—Robert G. Nilson

*Attorney, Agent, or Firm*—Toren, McGeady and Stanger

[57] ABSTRACT

A control valve is provided between a direction-changeover valve and an actuator in a fluid-pressure operating system. This control valve includes a body having an inlet and an outlet; a fluid passage interconnecting the inlet and the outlet; a valve body and a valve seat which are cooperative with each other to define a clearance therebetween and positioned within the fluid passage; a spring for resiliently urging the valve body toward a constrictive position to where a diminished clearance is defined between the valve body and the valve seat; and pressure responsive means for displacing the valve body in an opposite direction against the force applied by the spring thereby enlarging the clearance and bringing the valve body to its fully open position. An adjusting rod enabling adjustment of the first position of the valve body is provided, and a pilot piston operates under a pilot fluid pressure applied through a pilot port for forcing the valve body to its fully open position.

5 Claims, 28 Drawing Figures

CONTROL VALVE

BACKGROUND OF THE INVENTION

1. Field of the Invention

This invention relates to a control valve for use in a fluid-pressure operating system, and more particularly to a control valve positioned between a direction-changeover valve and an actuator. Furthermore, this invention is associated with a control valve which may prevent an impulsive operation of an actuator by slowing down the movement of a piston under a meter- in control, such as when no fluid pressure is applied to an actuator at the starting of operation and yet may accelerate the movement of a piston during the operation except for a starting phase of the operation.

2. Description of the Prior Art

Hitherto, for adjusting the speed of a piston reciprocating within a cylinder in an actuator, a meter-out control system has been adopted for use as a speed controller. However, the meter-out control system poses a problem in that, for instance, after the operation, or inspection of equipment, the pressure within the cylinder remains at an atmospheric pressure level, with the result that the speed control of a piston is possible only when pressure is applied to the controller, and hence the speed control of the piston is disabled in a condition where no pressure is not applied. As a result, there often occurs damage to fixtures or injury of an operator. Accordingly, an operator must pay close attention at the commencement of operation so that efficiency is lowered.

For the aforesaid reasons, the speed controller is used in a meter-on control mode. Although this attempt meets with partial success in preventing impulsive movement of the piston at the starting of operation, there arises the disadvantage that an excessively long time is required until the fluid pressure is built up within the cylinder, hence lowering the speed of the piston, so that a delay in transmission of pressure occurs, with an accompanying loss in operation.

It is an object of the present invention to provide a control valve, which insures a safe operational speed for an actuator, without causing a loss in operation.

It is another object of the present invention to provide a control valve which may retard the starting speed of a piston but accelerate the speed of the piston during operation except for the starting phase thereof.

SUMMARY OF THE INVENTION

According to the present invention, a control valve is provided between a direction-changeover valve and an actuator for use in a fluid-pressure operating system, wherein the control valve comprises: a body having an inlet and an outlet; a fluid passage interconnecting the inlet and the outlet; a valve body and a valve seat which are cooperative with each other to define a clearance therebetween and positioned in the fluid passage; resilient means for resiliently holding the valve body in a constrictive position to diminish the clearance defined between the valve body and the valve seat; and pressure responsive means for forcing the valve body in the direction opposite to that of the force applied by the resilient means for bringing the valve body to its fully open position.

According to another aspect of the present invention, there are further provided an adjusting rod adapted to adjust the constrictive position of the valve body, as required, and a pilot piston adapted to be operated under a pilot pressure applied through a pilot port for forcing the valve body to its fully open position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1A:
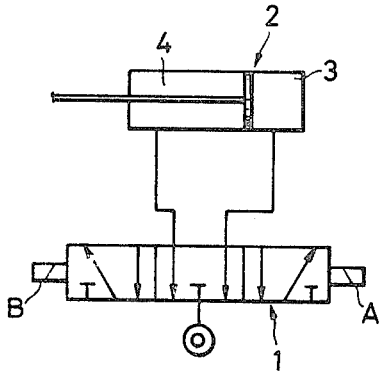
FIG. 1A is a schematic representation of the type of system with which the present invention may be used.

Referring to FIG. 1A, there is shown a generalized schematic diagram of a penumatic circuit of the type with which the present invention may be used. Compressed air is introduced into a chamber 3 in an actuator 2 through a direction-changeover valve 1, while compressed air is discharged from the other chamber 4 in the actuator 2. As is clear from FIG. 1B, a piston is displaced at a given speed due to the pressure difference between the chambers 3, 4.

Figure 1B:
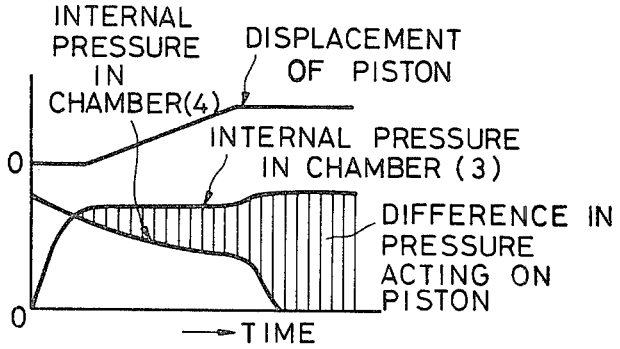
FIGS. 1B and C are plots illustrative of the operations of the circuit of FIG. 1A.
Figure 1C:
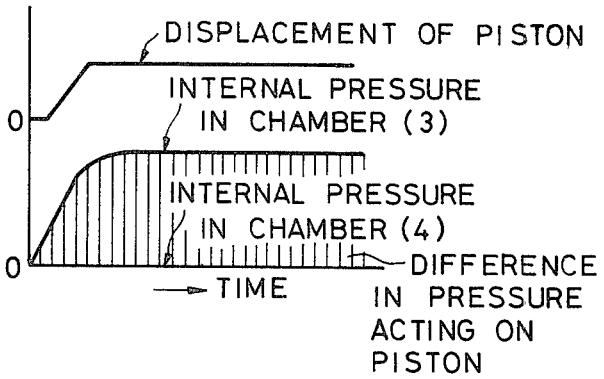

However, if the direction-changeover valve 1 is switched from an exhaust center neutral position to exhaust compressed air from the actuator, to a position to supply compressed air to the chamber 3, then the piston is subjected to an excessively large force due to compressed air flowing into the chamber 3, with the result that as can be seen from FIG. 1C, the piston is moved in an abrupt or impulsive manner. This leads to damage of equipment and injury to an operator.

In general, an exhaust center type changeover valve is used for safety purposes to prevent accidents by discharging the working fluid from an actuator in a rest condition of equipment. This gives rise to some contradiction, however, because of the danger at the beginning of the operation, as has been described above.

The present invention is directed to avoiding the aforesaid shortcomings by providing a control valve which insures desired safety for a fluid pressure operating system.

Figure 2:
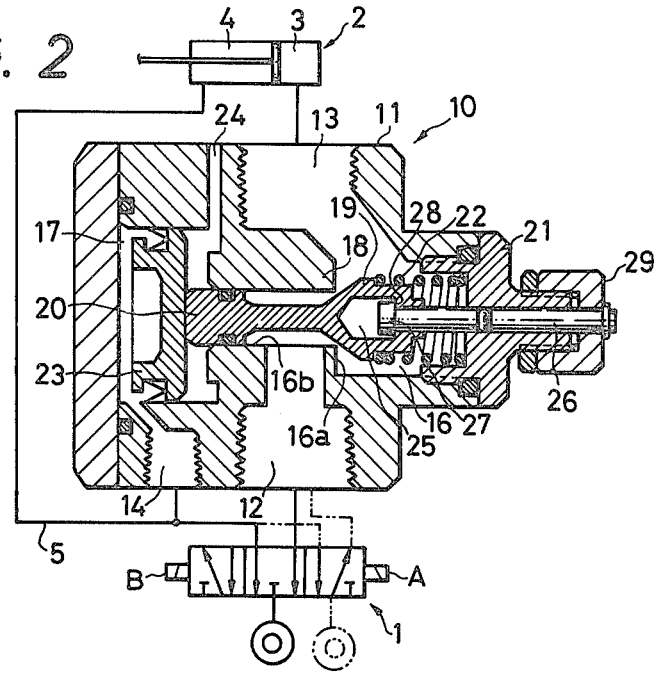
FIGS. 2 and 3 are cross-sectional views of the first embodiment of the invention, in the varying operational conditions.
Figure 3:
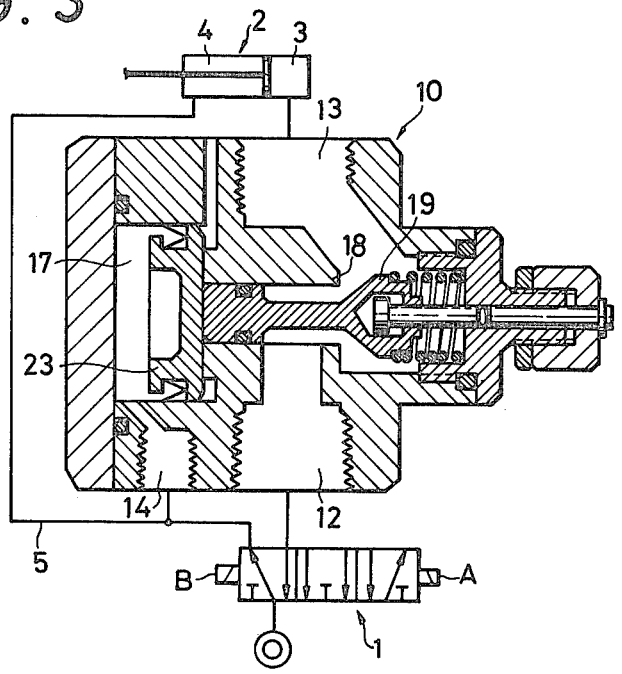

FIGS. 2 and 3 show one embodiment of the present invention.

A body of a control valve 10 is provided with a port 12 communicated with a direction-changeover valve 1, a port 13 communicated with one chamber 3 in an actuator 2, and a pilot port 14 communicated with the other chamber 4 in the actuator 2. Provided interiorly of the body of the valve 10 is a valve chamber 16 which consists of a large-diameter chamber **16*a* and a small-diameter chamber 16*b*, with a valve seat defined therebetween. Further provided in the body of the valve 10 is an auxiliary chamber 17 of a large diameter, which is communicated with the small-diameter chamber 16*b* at one end thereof. The port 12 and port 13 are communicated with the small-diameter chamber 16*b* and large-diameter chamber 16*a*, respectively. In addition, the pilot port 14 is communicated with the auxiliary chamber 17**.

A valve body 19 is positioned within the valve chamber 16 forming part of a fluid passage, in opposed relation to the valve seat 18, thereby restricting or diminishing a clearance defined in cooperation with the valve seat 18. A balance piston 20 is integral with the valve body 19 which is fitted in the small-diameter chamber **16*b* in a reciprocating manner. A spring 22 is confined between the valve body 19 and a plug member 21 closing the valve chamber 16. A pilot piston 23 of a large diameter is slidingly fitted in the auxiliary chamber 17 and abuts the end of the balance piston 20**.

The pilot port 14 is communicated with the auxiliary chamber 17 on the rear side of the pilot piston 23, while a discharge port 24 is communicated with the auxiliary chamber 17 on the front side of the pilot piston 23, for discharging a back pressure, when the pilot piston is displaced.

A cavity 25 is defined in the valve body 19, with one end of an adjusting rod 26 being inserted therein. The rod 26 slidingly extends through the plug body 21. The adjusting rod 26 has a locking head portion 27 which normally abuts the wall or a shoulder portion 28 of the cavity 25 under the resilient action of a spring 22. The locking head portion 27 is loosely fitted in the cavity and does not abut the bottom portion of the cavity 25, when the valve body 19 assumes its fully open position (FIG. 3), being biased by the pilot piston 23. A knob 29 is secured on the other end portion of the adjusting rod 26 in a manner to be threadedly fitted on the plug member 21. The rotation of knob 29 allows adjustment of the position of the valve body 19 by appropriate location of the adjusting rod 26, i.e., by adjustment of the clearance defined between the valve body 19 and the valve seat 18.

Referring to this operation of the first embodiment of the invention, there is shown in FIG. 2 the first or constrictive position, wherein a pilot fluid pressure is not applied to the pilot port 14. In case the changeover valve 1 assumes an exhaust center neutral position as shown, both chambers 3, 4 in the actuator 2 are communicated with atmospheric pressure, and thus the valve body 19 is not subjected to the action of a fluid, with the locking head portion 27 of the adjusting rod 26 abutting the shoulder portion 28 of the cavity 25 under the action of a spring, thereby restricting the clearance between the valve body 19 and the valve seat 18. In other words, the control valve 10 assumes the first changeover position, while the pilot piston 23 is biased to the left, being pushed by the balance piston 20.

If the changeover valve 1 is changed over to the side A (shown by chain lines in FIG. 2), the port 12 is communicated with a fluid source. However, the valve body 19 remains still and hence maintains the aforesaid first or constrictive position, because the balance piston 20 integral with the valve body 19 is biased to the left under the action of spring 22, and the pilot port 14 is communicated with the atmosphere, so that the pilot piston 23 is not moved. As a result, control fluid introduced through the port 12 flows through the clearance betwen the valve body 19 and the valve seat 18, with the flow rate of a fluid being restricted, and then from the port 13 into the chamber 3 in the actuator 2, with the result that the piston in the actuator 2 makes a slow start in a meter-in control mode due to the restricted clearance betwen the valve body 19 and the valve seat 18.

When the direction-changeover valve 1 is switched to the position B, as shown in FIG. 3, and then port 12 is brought into communication with the atmosphere, while the pilot port 14 and the other chamber 4 in the actuator 2 are communicated via a pipe 5 with a fluid source, then the pilot piston 23 is immediately moved or biased under a fluid pressure introduced through the pilot port 14 into the auxiliary chamber 17, so that the valve body 19 is biased to the right, thereby providing a second or open position, wherein the clearance between the valve body 19 and the valve seat 18 is fully enlarged. In this respect, the diameter of pilot piston 23 is sufficiently large to respond to a fluid pressure, even if the fluid pressure is considerably low. As a result, a fluid flows out of the chamber 3 in the actuator 2 without being subjected to any resistance, with the result that the piston is retracted at a given speed in the actuator due to a difference in pressure between the chamber 3 and the chamber 4, into which a pressure fluid is supplied from a fluid source. This makes no difference to the operation of two-port, two-way valve. (FIG. 1B)

In addition, when the direction-changeover valve 1 is switched from the side B to the side A, then the chamber 4 in the actuator 2 is kept open to atmosphere, whereupon a fluid is introduced from a fluid source via control valve 10 into chamber 3. In this respect, as has been described earlier, the pilot piston 23 is susceptible even to a low level of pressure, so that as far as there remains a pressure in the pipe 5, the pilot piston 23 maintains its biased condition (to the right), thereby maintaining the valve body 19 in its fully open position relative to the valve seat 18, with the result that no fluidic resistance is encountered by fluid flowing into the chamber 3. Accordingly, the actuator 2 operates in the same manner as that of the ordinary two-port, two-way valve. It should be noted that after fluid pressure in the pipe 5 has been lowered almost to atmospheric pressure, i.e., the piston in the actuator has completed its forward displacement, the valve body 19 returns to its constrictive or first position.

As is apparent from the foregoing description of the control valve according to the first embodiment of the invention, the inflow of a fluid into the actuator is limited or restricted, only when starting from an exhaust center neutral position or from a condition where fluid pressure in the actuator is removed therefrom, thereby allowing a slow start for the actuator, while the piston in the actuator may be moved or operated at a given speed, without any limitations being thereafter imposed thereon.

Meanwhile, for changing the speed of a piston in an actuator, it suffices to provide a throttle valve or speed control valve for the direction changeover valve 1. Alternatively, a manual throttle valve may be incorporated into the control valve 10 according to the present invention for a meter-out speed control.

Figure 4:
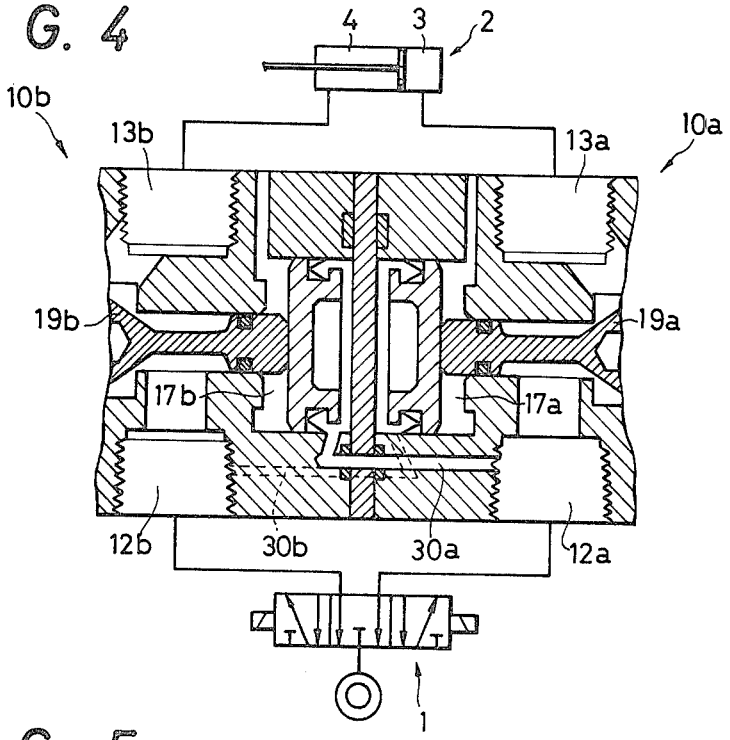
FIGS. 4 to 6 are cross-sectional views of the second to fourth embodiments of the invention.

FIG. 4 shows a control valve according to a second embodiment of the invention, in which the speed of a piston in actuator 2 may be controlled both for the forward movement and backward thereof. The control valve includes two control valves 10*a*, 10*b* which are similar of construction to the control valve 10 in the first embodiment. Ports 12*a*, 12*b* are communicated with the direction-changeover valve 1, while ports 13*a*, 13*b* are communicated with chambers 3, 4 in the actuator 2, respectively. According to the second embodiment, the ports 12*a*, 12*b* are communicated through pilot communicating-passages 30*a*, 30*b* with auxiliary chambers 17*b*, 17*a*, respectively. The construction and operation of this valve do not differ substantially from the valve according to the first embodiment, and hence a detailed description thereof will be omitted.

Figure 5:
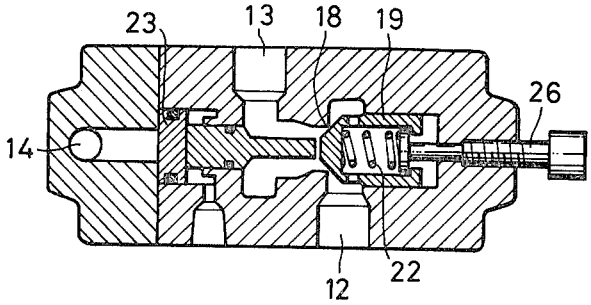

FIG. 5 shows a control valve according to a third embodiment of the invention.

The third embodiment shown in FIG. 5 differs from the first embodiment in the construction of the valve body 19 relative to the pilot piston 23, and the relative position of the port 12 and port 13, and in that a spring 22 is confined between the adjusting rod 26 and the valve body 19, although the functions of the valve are not different from the first embodiment. However, according to the third embodiment, the valve body 19 and the valve seat 18 provide a fully open position or maximum clearance, upon completion of operation, when the direction-changeover valve 1 is returned from the changeover position A or B to its neutral position, while the first embodiment of the invention assumes a constrictive position. Selection between the first and third embodiment depends on the loading mode of the actuator.

Figure 6:
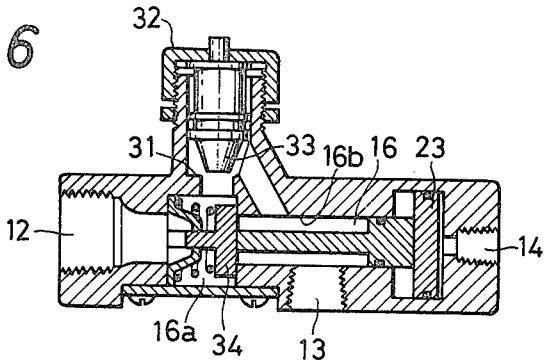

FIG. 6 shows a control valve according to a fourth embodiment of the invention. A valve chamber 16 provided in a body of the control valve consists of a large-diameter chamber 16*a* and a small-diameter chamber 16*b*, with a by-pass running therebetween. An auxiliary valve seat 31 is provided in the by-pass in opposed relation to a variable throttle valve body 33, whose position is adjustable by means of a knob 32, thereby restricting the flow of a fluid by the cooperation of the valve seat 31 with the variable throttle valve body 33. Upon starting of an actuator, fluid is introduced from the port 12 through a clearance defined between the variable valve body 22 and the auxiliary valve seat 31 and then through the outlet 13 into the actuator, thereby effecting slow starting of the actuator. Thereafter the pilot piston 23 and valve body 34 are operated in the same manner as that of the first embodiment, thereby allowing the piston in the actuator to move at a given speed.

Figure 7A:
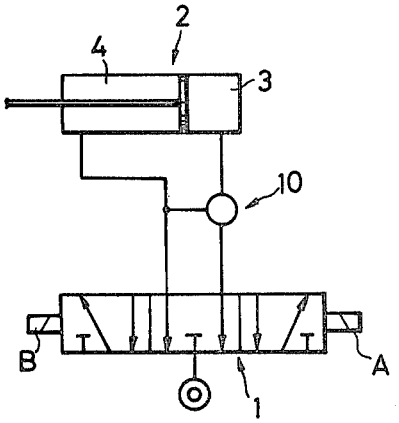
FIG. 7A is a fundamental circuit diagram depicting schematically the general arrangement of the invention.
Figure 7B:
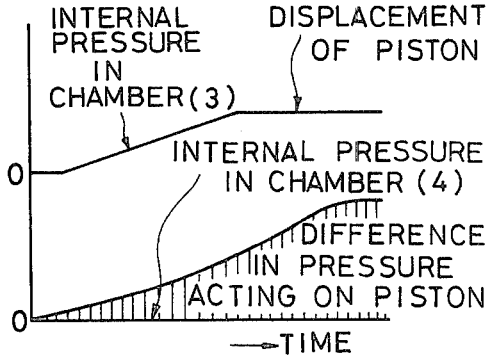
FIG. 7B is a plot illustrative of the general operation of the circuit of FIG. 7A.

FIG. 7A shows a fundamental circuit diagram including the control valve according to the present invention. FIG. 7B is illustrative of the operation of the circuit.

The control valve according to the present invention may be connected to a speed control valve, changeover valve or actuator. However, these components may be incorporated into a single valve body so as to provide a composite valve construction.

As is apparent from the foregoing description of the control valve according to the invention, there are provided a valve body whose spacing or clearance relative to the valve seat may be adjusted, an adjusting mechanism adapted to set the first or constrictive position of the valve body, as required, a spring for loading the valve body in a desired direction, and a pilot piston adapted to bring the valve body to a fully open position. As a result, at the starting of an actuator, wherein fluid pressure is completely removed therefrom, impulsive or abrupt movement of a piston may be prevented and slow starting operation may be effected under a meter-in control mode, thereby eliminating dangers and various drawbacks experienced with the prior art circuit, with the resulting desired safety.

Figure 8:
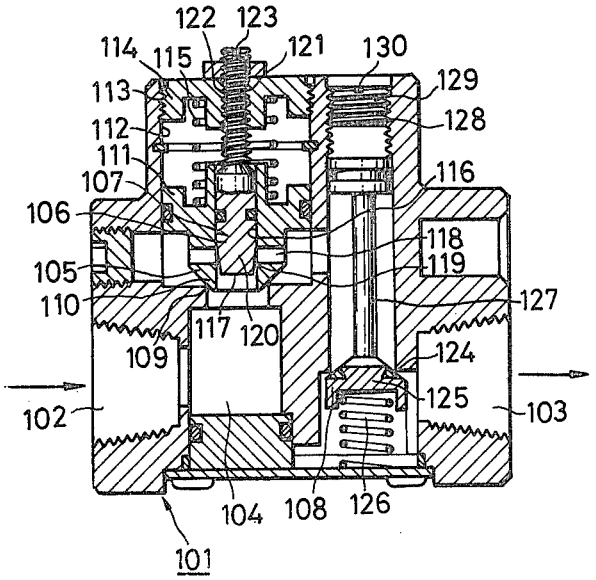
FIG. 8 is a vertical cross-sectional view of the control valve according to a fifth embodiment of the invention.

FIG. 8 shows a control valve according to a fifth embodiment of the invention. A body 101 is provided with ports 102, 103 as inlet and outlet for a fluid. The ports 102, 103 are interconnected by a fluid passage 104, in which there are provided two-port, two-way valve 105 of a spring-offset pilot type, serving as a flow rate control valve, and a needle valve 106 serving as a throttle valve, in the form of a composite main valve 107. In addition, a check valve 108 is provided in series relation to the composite main valve 107.

In accordance with the arrangement of the composite main valve 107 a valve body 110 cooperates with a valve seat 109 formed in the body 101 of the valve 107. A piston 111 is integral with the valve body 110. The piston 111 is fitted in cylinder 112 in a water-tight relationship, the piston 111 forming part of the body 101. An internally-threaded cylindrical wall 113 extends from the cylinder 112, and a seat member 114 is fitted in the wall 113. A spring 115 is confined between the piston 111 and the seat member 114.

According to the two-port-two-way valve 105, pressure prevailing in the port 103 is applied to the piston 111 as a pilot pressure, so that the valve body 110 departs from the valve seat 109 against the action of the spring 115, thereby opening the passage 4. A needle valve 106 is built in the valve 105. More particularly, a needle 120 is movable in a passage 116 running through a central portion of the valve body 110 and the piston 111. A tip portion 117 of needle 120 operates to vary the opening defined between a transverse passages 118 in the valve body 110 and the passage 116. The rear end portion of the needle valve 120 is threaded as at 121, the threaded portion 121 being threaded into a threaded hole 122 defined in the valve body 114, with the outer end the portion 121 projecting externally of the body of the valve. A slot 123 is provided in the outer end of the threaded portion 121 for facilitating rotating the needle 120 by means of a screw driver, with the tip of the screw driver being fitted in the slot 123.

A check valve 108 is provided on the fluid passage 104 in series relation to the composite main valve 107. The check valve includes a valve seat 124, a valve body 125 cooperative with the valve seat 124, a spring 126 for resiliently forcing the valve body 125 against the valve seat 124, and a push rod 127 for use in keeping the valve body 125 off the valve seat 124. The push rod 127 is coupled to a cylindrical member 129 threadedly fitted in an internally-threaded cylindrical wall 128 forming part of the body 101. Defined in an end face of the threaded cylindrical body 129 is a slot 130, into which the tip of a screw driver way be fitted.

Figure 9:
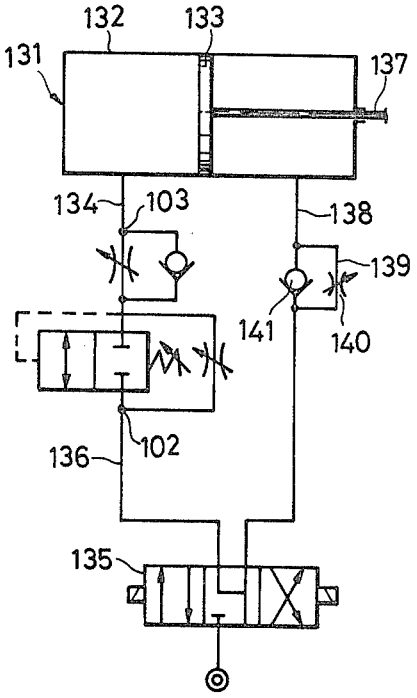
FIG. 9 is a schematic circuit diagram of the fifth embodiment of the invention shown in FIG. 8.

FIG. 9 shows a circuit diagram illustrative of the operation of the control valve of the aforesaid arrangement. A piston 133 in an actuator 131 partitions the interior of a cylinder 132 into a head-side chamber and a rod-side chamber. A pipe 134 is connected to the head-side chamber as well as to a port 103. A port 102 is connected to a pipe 136 communicated with a solenoid valve 135. On the other hand, a pipe 138 extending from the rod-side chamber 137 of the cylinder 132 is connected to the solenoid valve 135. Provided on the pipe 138 is a speed controller 139 for a meter-out control. The speed controller 139 consists of a variable throttle valve 140 arranged in parallel with the pipe 138, and a check valve 141 which is arranged in series therewith.

Figure 10:
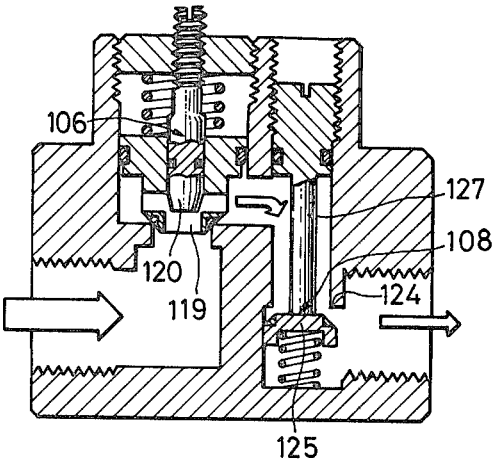
FIGS. 10 to 12 are views illustrative of the respective operational conditions of the fifth embodiment shown in FIG. 8.

With the aforesaid circuit arrangement, when fluid is supplied from the port 103 into the cylinder 132, as shown in FIG. 10, the fluid slowly flows through a restricted opening defined by a needle 120 in the needle valve 106 and then through a clearance defined between the valve body 125, which is pushed by the push rod 127, and the valve seat 124, so that the piston 133 in the cylinder 132 moves slowly, (FIG. 9).

Figure 11:
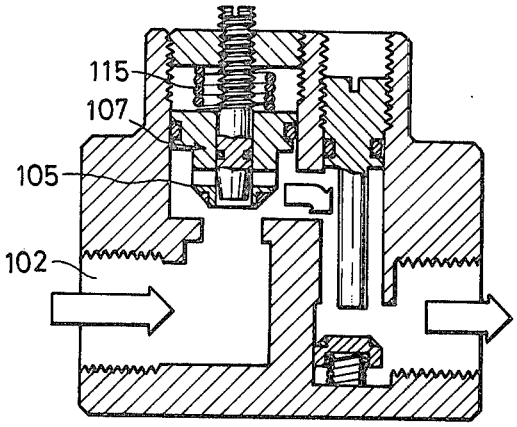

FIG. 11 shows the condition where the piston rod 137 is pushed out. In this case, fluid pressure supplied to the port 102 is higher than the pressure set by the spring 115, with the result that the changeover valve 105 in the composite main valve 107 is brought to its fully open position, so that the speed of piston 133 in the cylinder 132 is controlled by the speed controller 139 on the side of piston rod 137, independently of the control valve according to the present invention.

Figure 12:
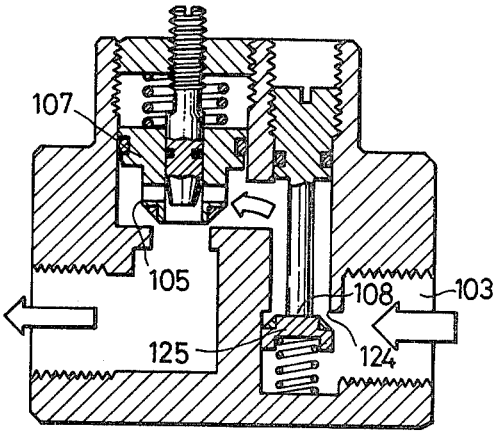
Figure 13:
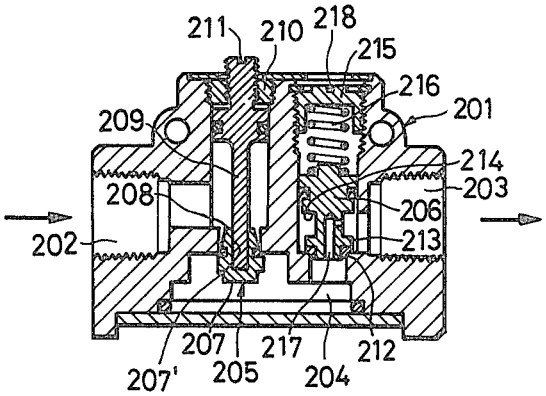
FIG. 13 is a vertical cross-sectional view of a sixth embodiment of the invention.

When the piston rod 137 is retracted, as shown in FIG. 12, the changeover valve 105 in the composite main valve 107 maintains its fully open position due to pressure on the side of a head chamber, i.e., the port 103, so that the speed of piston 133 in the cylinder 132 is controlled by the opening in the check valve 108 i.e., the clearance defined between the valve body 125 and the valve seat 124.

FIGS. 13 to 18 show the sixth embodiment of the invention. The body 201 of a control valve is provided with a port 202 connected to a direction-changeover valve, and a port 203 connected to a cylinder in an actuator. A fluid passage 204 in the body 201 interconnects the ports 202, and 203. A series connection of a throttle valve 205 and a pressure control valve 206 is provided on the passage 204 from the port 202 towards the port 203. The throttle valve 205 restricts the flow of fluid due to the clearance defined between a valve body 207 and a valve seat 208, when a fluid flows from the port 203 towards the port 202. However, the throttle valve 205 fails to restrict the flow of fluid, when flowing in the direction opposite to the former, i.e., from the port 202 towards the port 203, because the valve stem 209 of the valve body 207 is loosely fitted in a central hole 207', with the result that the valve body 207 is simply pushed downwards, leaving ample clearance for the fluid. Meanwhile, the valve stem 209 protrudes outwardly from the body 201, and is threaded into a seat member 210 provided on the body 201. By rotating a screw driver fitted in the slot 211 defined in the end face of valve stem 209, the stem 209 may be moved in or out of the seat member 210, thereby adjusting the clearance between the valve body 207 and the valve seat 208.

A pressure-adjusting valve 206 consists of a valve body 213 to be seated on a valve seat 212, a piston integral with the valve body 213, and a pressure adjusting spring 216 confined between the piston 214 and a pressure adjusting member 215. When pressure prevailing on the side of the port 203 exceeds a given level set by the pressure adjusting spring 216, the valve body 213 departs from the valve seat 212, following the retracting movement of the piston 214. In this embodiment, however, a narrow passage 217 is provided in the valve body 213, as shown, so that a small amount of fluid may pass through the narrow passage 217. In the case of the pressure adjusting valve 206, as well, by rotating a screw driver, with the tip thereof being fitted in a slot 218 provided in the end face of the pressure-adjusting membe 215, a pressure adjusting memer 215 threaded into the body 201 may be moved relative to the body 201, so that the force of the pressure adjusting spring 216 may be adjusted, thereby adjusting the set pressure level.

With the aforesaid circuit arrangement, there is no possibility that in the initial phase of operation under a meter-out control mode, pressure fluid will be abruptly supplied into the cylinder chamber and thus drive the piston into abrupt movement. In other words, in the starting phase of operation, a small amount of fluid flows through the narrow passage 217, and then the valve body 213 is brought to its fully open position, as the pressure on the side of port 203 is gradually built up, thus providing a desired and safe speed for the piston.

Figure 14:
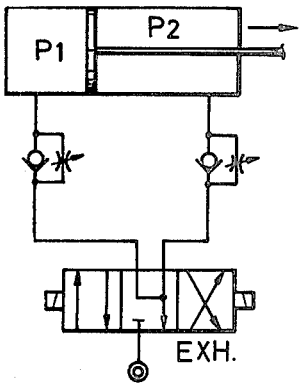
FIG. 14 is a schematic circuit diagram of the device of FIG. 13.
Figure 15:
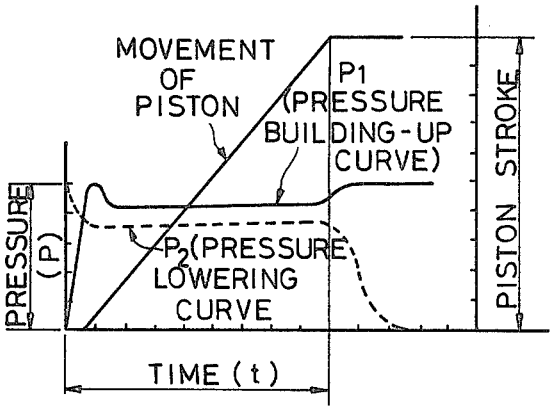
FIGS. 15 and 16 are plots illustrative of the operational conditions of the circuit of FIG. 14.
Figure 16:
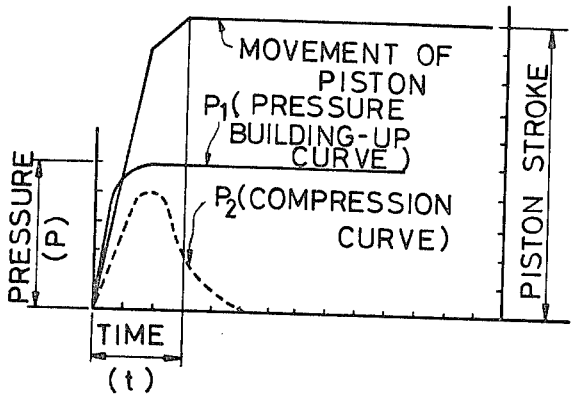
Figure 17:
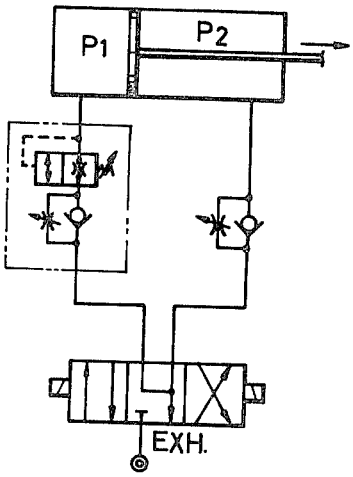
FIG. 17 is a circuit diagram, in which a control valve according to the sixth embodiment is incorporated.
Figure 18:
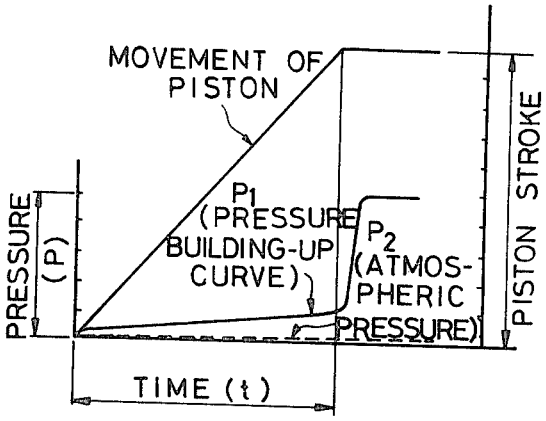
FIG. 18 is a plot illustrative of the operation of the circuit of FIG. 17.

FIG. 14 shows the case wherein an ordinary type speed controller alone is used. FIG. 15 shows the operational condition when pressure is applied. FIG. 16 shows the operational condition where no pressure is applied. FIG. 17 shows a circuit arrangement, where the control valve according to the present invention is incorporated. In his circuit arrangement, there may be achieved stable operation, when no pressure is applied, as established by FIG. 18.

Figure 19:
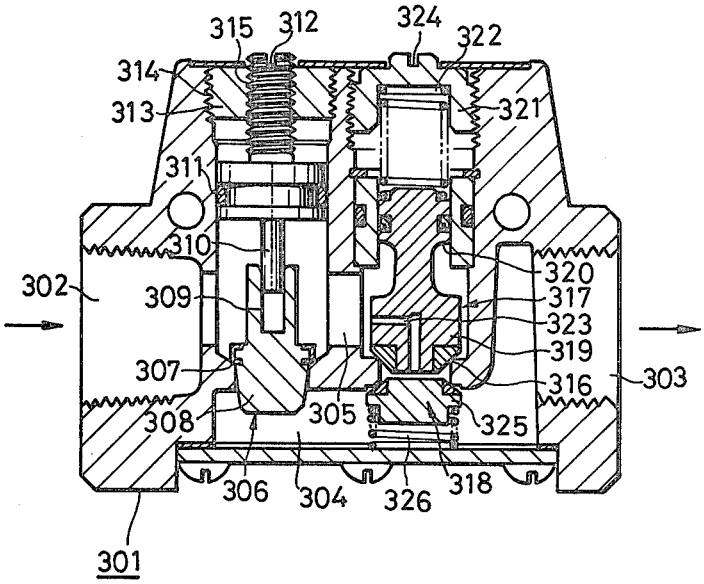
FIG. 19 is a vertical cross-sectional view of a seventh embodiment of the invention.
Figure 20:
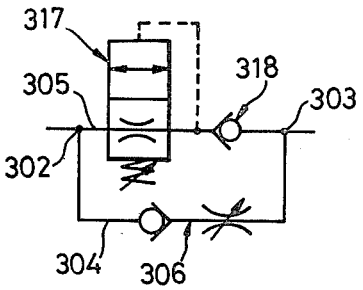
FIG. 20 is a circuit diagram including the control valve shown in FIG. 19.
Figure 21:
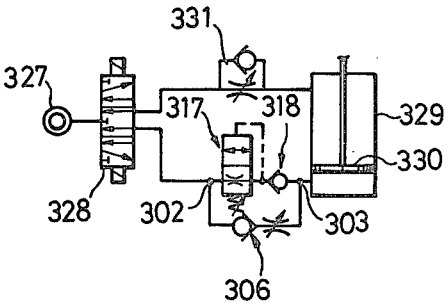
FIG. 21 is a circuit diagram including the control valve according to the fourth embodiment of the invention.

FIGS. 19 to 21 show a seventh embodiment of the invention. The body 301 of a control valve is provided with a port 302 connected to a direction-changeover valve, and a port 303 connected to a cylinder in an actuator. Provided in parallel in the body 301 are two fluid passages 304, 305. A valve member 306, provided on one of the passages (304), serves as a check valve for fluid flowing in the normal direction i.e., from the port 302 towards the port 303, and as a throttle valve for fluid flowing in the direction opposite thereto. The valve member 306 is of such an arrangement that: a valve body 308 is seated on a valve seat 307 provided on the passage 304 from the side of the port 302; a valve stem 310 is loosely fitted in a center hole 309 defined in the valve body 308; the valve stem 310 protrudes from the valve body externally, being sealed with an O-ring 311 in air-water tight relation; the end face of stem 310 is provided with an adjusting slot 312; and the valve stem 310 having a thread 315 is fitted in a female thread formed on a seat member 313 secured to the body 301. Rotation of a screw driver, with its tip fitted in slot 312, allows the rotation of the valve stem 310, thereby adjusting the relative position of the valve body 308 to the valve seat 307. In this case, the peripheral surface of valve body 308 is tapered, so that the opening or clearance between the valve body 308 and the valve seat 307 may be continuously varied.

On the other hand, a valve body 317 is placed on the side of the port 302 in opposed relation to a valve seat 316 formed on the other passage 305. The valve member 317 and the valve seat 316 which allow the flow of fluid in the aforesaid normal direction, serve as throttle valve when a pressure is below a set pressure, and fully opened under pressure over a set pressure level. In addition, a check valve body 318 is placed on the side of port 303 for blocking the flow of fluid in the direction opposite to the aforesaid normal direction. The valve member 317 consists of a valve body 319 opposed to the valve seat 316, and a pressure-adjusting spring 322, confined between the piston 320 and a pressure-adjusting member 321. In addition, a narrow passage 323 is provided in the valve body 319 for allowing the communication between the port 302 and the port 303, thereby forming a fixed throttle valve. In addition, an adjusting slot 324 is provided in the end face of the pressure-adjusting member 321. In this respect, as well, the tip of a screw driver may be fitted in the slot 324. A fluid pressure on the side of port 302 (primary pressure) is applied to the piston 320 of the valve member 317. In case this pressure is lower than a pressure level set by the pressure adjusting spring 322, fluid flows through the narrow passage 323, with the flow of fluid being restricted. When the pressure in port 303 exceeds the set pressure level, then the pressure adjusting spring 322 is compressed, so that the valve body 319 departs from the valve seat 316 to its fully open position, so that fluid may freely flow to the secondary side, i.e., towards the port 303. In this case, the valve body 325 of the check valve 318 provided downstream of the valve member 317 is seated on the valve seat 316 from the side of port 303 under the action of spring 326. The valve body 325 allows the flow of fluid in the normal direction but blocks the flow of fluid in the opposite direction, i.e., from the port 303 towards the port 302.

With the aforesaid circuit arrangement, fluid is introduced from a direction-changeover valve through the port 302 into the body 301. At this time, the passages 304 is blocked by the valve member 306 serving as a check valve, so that pressure fluid flows through the passage 305 towards the valve member 317, past the narrow passage 323, and opens the valve body 325 to flow into the port 303, and then from there into the cylinder of an actuator. When fluid pressure is built up over a pressure level set by the aforesaid pressure adjusting spring 322, then the piston 320 compresses the pressure adjusting spring 322 so as to allow the valve body 319 to depart from the valve seat 316, and the valve member 317 is brought to its fully open position, thereby allowing a large amount of fluid to flow into the cylinder in the actuator. In other words, the amount of fluid to be initially fed to the cylinder is small, so that abrupt or impulsive movement of the piston may be prevented.

When fluid flows in the direction opposite to the normal direction, i.e., from the port 303 to the port 302, the fluid should pass through the fluid passage 304. In this respect, the valve member 306 serves as a throttle valve, thereby adjusting the amount of fluid flowing therethrough, commensurate with a clearance defined between the valve body 306 and the valve seat cooperative therewith.

FIG. 20 shows a circuit diagram of the aforesaid arrangement. FIG. 21 shows a diagram illustrative of the arrangement of a control valve incorporated in a fluid circuit. In FIG. 21, there are shown at 327 a pressure fluid source, at 328 a direction changeover valve, at 329 a cylinder in an actuator, and at 330 a piston. The control valve according to the present invention is connected to the head-side chamber in the cylinder 329, while a speed controller 331 is connected to the rod-side chamber in the cylinder 329. FIG. 21 shows a meter-out control mode, while preventing impulsive movement of a piston.

Figure 22:
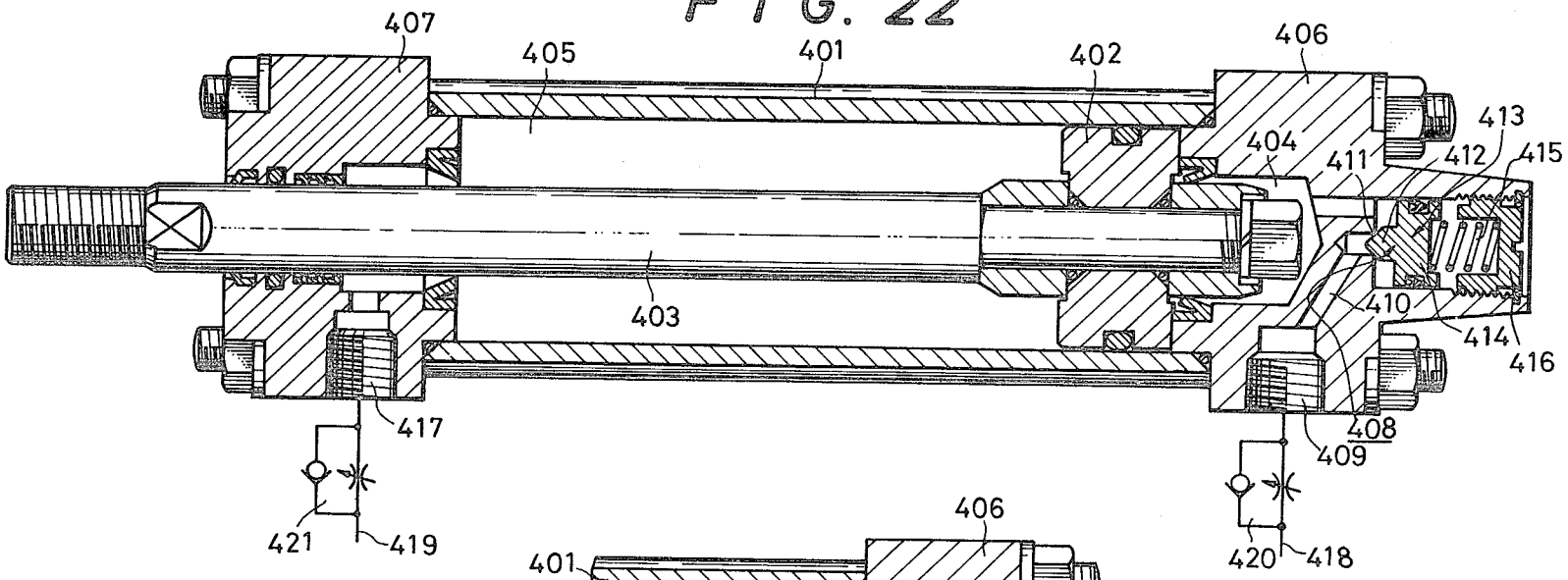
FIG. 22 is a vertical cross-sectional view of an eighth embodiment of the invention.

FIGS. 22 shows an eighth embodiment of the invention. A piston 402 is slidingly fitted in the cylinder 401 of an actuator in air-gas tight relationship therewith. A piston rod connected to the piston 402 protrudes from the cylinder 401 so that the movement of piston rod 403 is converted into useful work.

The opposite ends of the cylinder 401, whose interior is partitioned by the piston into two chambers 404, 405, are closed with plugs 406, 407. In this embodiment, a control valve 408 according to the present invention is incorporated in the plug 406 on one side of the piston. The control valve 408 may be incorporated in the plug 407 on the side of the rod 403. Alternatively, the control valves 408 may be incorporated in the plugs 406,407 on both sides.

According to the embodiment shown in FIG. 22, a control valve 408 consists of: a valve body 412 positioned on a passage 410 interconnecting the chamber 404 and a port 409 provided in the plug 406, for providing a restricted passage 411; and a pressure-responsive member 413 which disables the restricting function of the valve body 412, when a pressure in the passage 410 is built up to a certain level. The pressure-responsive member 413 consists of a piston member 414 integral with the valve body 412, a spring 415 loading the piston member 414, and a seat 416 for the spring 415.

A port 417 communicated with the chamber 405 is provided in the other plug 407.

With the aforesaid circuit arrangement, speed controllers 420, 421 are provided on supply pipes 418, 419 leading from the direction-changeover valve to respective ports 409, 417. A pressure fluid which has been supplied from the direction-changeover valve through the pipe 418 into the port 409 is introduced through a clearance defined between the valve body 412 and a valve seat cooperative therewith, i.e., through the narrow passage 411 into the chamber 404. Due to a pressure rise in the chamber 404, the piston member 414 is moved so as to have the valve body 412 depart from its seat, after which a fluid is supplied in the fully open condition of the passage 410, thereby accelerating the movement of piston 402. Even in case the piston 402 is displaced in the opposite direction, the valve body 412 functions in a meter-out control mode, thereby suppressing impulsive movement of the piston 402.

Figure 23:
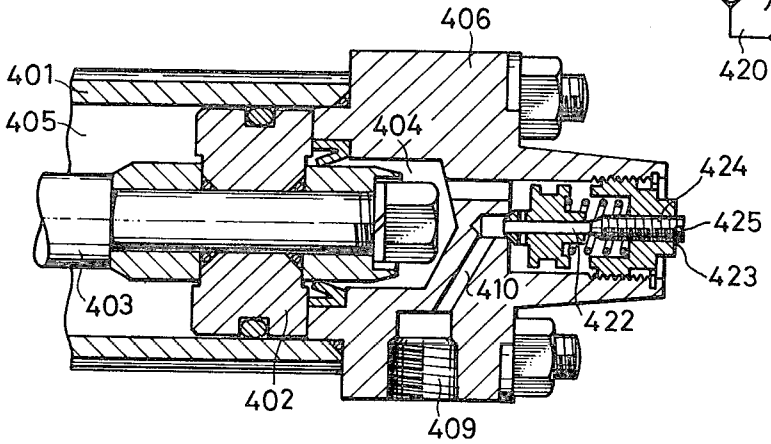
FIG. 23 is a partial vertical cross-sectional view depicting a ninth embodiment of the invention.

According to a ninth embodiment of the invention, as shown in FIG. 23, a valve stem 422 is secured to the valve body 412, and extends through the piston member 414 and a seat 416, and protrudes externally thereof. At this time, a threaded portion 423 formed on part of the valve stem is fitted in a threaded hole 424 provided in the seat 416. By inserting and rotating the tip of a screw driver into a slot 425 defined in the end face of valve stem 422, the valve body 412 may be moved back and forth, thereby adjusting the opening of the narrow passage 411, other parts remaining unchanged as compared with those of the embodiment shown in FIG. 22.

Figure 24:
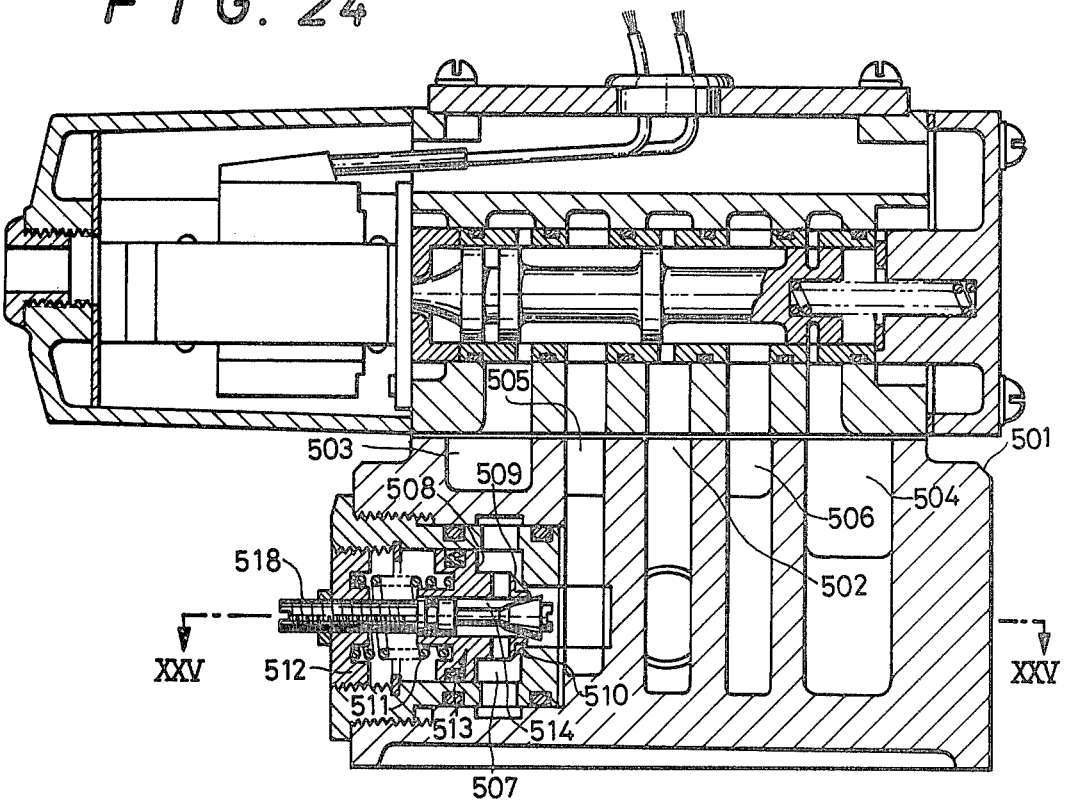
FIG. 24 is a vertical cross-sectional view of a tenth embodiment of the invention.
Figure 25:
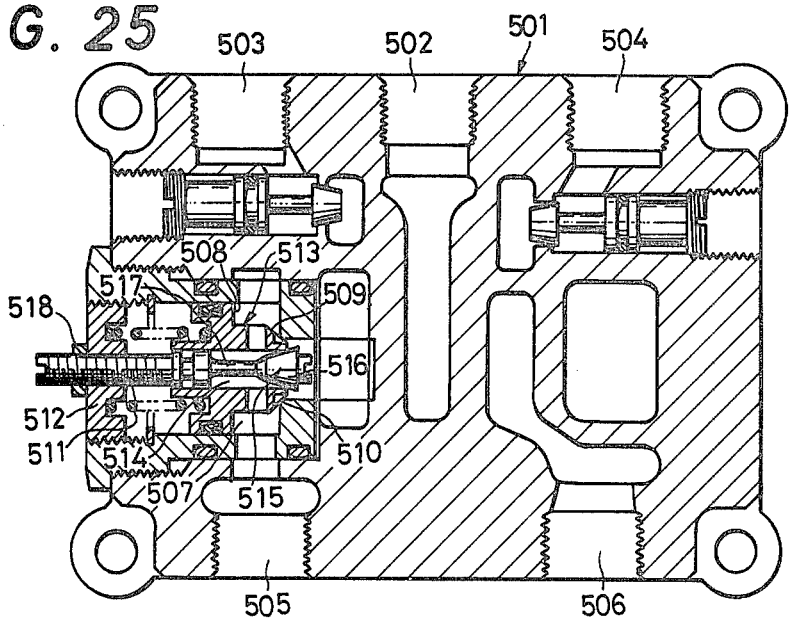
FIG. 25 is a cross-sectional view of the tenth embodiment taken along the line XXV—XXV of FIG. 24.

FIGS. 24 and 25 show a tenth embodiment of the invention. An electromagnetic valve body 501 has a supply port 502 and discharge ports 503, 504 with ports 505, 506 leading to a cylinder. A valve body 509 having a piston-like partition wall 508 is positioned on a fluid passage 507 provided in the body 501 but in the neighborhood of the port 505 leading to the cylinder. A pressure adjusting spring adapted to resiliently force the valve body 509 against the valve seat 510 is confined between the valve body 509 and the pressure adjusting member 512, thus providing a pressure adjusting valve 513. In addition a throttle valve 515 is provided in a through-hole 514 formed internally of the valve body 509 of the pressure adjusting valve 513. The throttle valve 515 includes a throttle valve member 516 adapted to adjust the opening of the through-hole 514, and a stem 517 secured to a valve body 516. The stem 517 extends through the body 516 and then outside thereof while a threaded portion of the stem 517 is threadedly fitted in the pressure adjusting member 512. Thus, by rotating the stem 517, a clearance defined between the valve body 516 and a valve seat cooperative therewith may be adjusted.

With the aforesaid circuit arrangement, the amount of a fluid which has been introduced through the supply port 502 into the passage is restricted by means of the throttle valve 515 for the first time, and then fed through the port 505 into the cylinder. When a pressure in the cylinder is built up to a certain pressure level, then the piston-like partition wall 508 is moved against a force of the pressure adjusting spring 511, so that valve body 509 may depart from the valve seat 510, so a fluid may flow through a wide passage into the cylinder. More particularly, the flow rate of a fluid may be suppressed in the beginning of an operation, thereby preventing impulsive movement of a piston in an actuator, while permitting the flow of a fluid in a large amount due to the displacement of the piston. This contributes to the safety of equipment using the control valve according to the present invention.

What is claimed is:

1. A control valve particularly adapted for use together with a direction-changeover valve and with an actuator cylinder, said control valve comprising: a casing defining a first port adapted to be placed in fluid flow relationship with said direction-changeover valve and a second port adapted to be placed in fluid flow relationship with said actuator cylinder; fluid passage means provided in said casing for interconnecting in flow relationship said first and said second ports; pressure adjusting valve means operable between an open and a closed position provided in said fluid passage means; spring means biasing said pressure adjusting valve means so as to be opened when pressure in said second port exceeds a given pressure level; and throttling means operatively associated with said pressure adjusting valve means defining a throttled fluid flow passage between said first port and said second port to permit throttled fluid flow therebetween past said pressure adjusting valve means when said pressure adjusting valve means is in the closed position; said fluid passage means defining a first fluid flow passage and a second fluid flow passage each extending between said first port and said second port, said pressure adjusting valve means being located to control fluid flow through said first fluid flow passage from said first port to said second port, said control valve further including throttling valve means defining a throttling fluid flow opening through which fluid may flow through said second fluid flow passage from said second port to said first port.

2. A control valve according to claim 1 wherein said pressure adjusting valve means comprise a valve body and a valve seat, said valve body being spring biased into engagement against said valve seat by said spring means to close said pressure adjusting valve means, said throttling means comprising a narrow through-hole extending through said valve body.

3. A control valve according to claim 1 further comprising a check valve located to permit fluid flow through said first fluid flow passage from said first port to said second port but operating to prevent fluid flow through said first fluid flow passage from said second port to said first port.

4. A control valve according to claim 1 wherein said spring means may be adjusted to adjust the spring biasing force exerted on said pressure adjusting valve means so as to adjust said given pressure level in said second port which must be exceeded in order for said pressure adjusting valve means to open.

5. A control valve according to claim 1 wherein said throttling valve means are adjustable in order to enable adjustment of said throttling fluid flow opening.

* * * * *

UNITED STATES PATENT OFFICE

CERTIFICATE OF CORRECTION

Patent No. 4,192,346 Dated March 11, 1980

Inventor(s) Tomomitus Iizumi

It is certified that error appears in the above-identified patent and that said Letters Patent are hereby corrected as shown below:

In the heading of the Patent [30] should read as follows:

[30] Foreign Application Priority Data:

| | | | | |
|---|---|---|---|---|
| Aug. 25, 1976 | [JP] | Japan | ,,,,,,, | 51-113601 |
| Sep. 10, 1976 | [JP] | Japan | ,,,,,,, | 51-121042 |
| Oct. 8, 1976 | [JP] | Japan | ,,,,,,, | 51-134892 |
| Oct. 27, 1976 | [JP] | Japan | ,,,,,,, | 51-144311 |
| Oct. 27, 1976 | [JP] | Japan | ,,,,,,, | 51-144312 |
| Jul. 5, 1977 | [JP] | Japan | ,,,,,,, | 52-88168 |

Signed and Sealed this

*First* Day of *July 1980*

[SEAL]

*Attest:*

SIDNEY A. DIAMOND

*Attesting Officer* *Commissioner of Patents and Trademarks*